US008887514B2

(12) United States Patent
Kimura

(10) Patent No.: US 8,887,514 B2
(45) Date of Patent: Nov. 18, 2014

(54) CRYOPUMP CONTROL APPARATUS, CRYOPUMP SYSTEM, AND METHOD FOR EVALUATING VACUUM RETENTION OF CRYOPUMPS

(75) Inventor: Toshiyuki Kimura, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 355 days.

(21) Appl. No.: 13/486,655

(22) Filed: Jun. 1, 2012

(65) Prior Publication Data

US 2012/0304669 A1 Dec. 6, 2012

(51) Int. Cl.

| | |
|---|---|
| ***B01D 8/00*** | (2006.01) |
| ***F04B 49/08*** | (2006.01) |
| ***F04B 37/08*** | (2006.01) |
| ***F04B 49/06*** | (2006.01) |

(52) U.S. Cl.

CPC ..... *F04B 37/08* (2013.01); *F04B 49/08* (2013.01); *F04B 49/065* (2013.01)

USPC ..... 62/55.5; 62/268

(58) Field of Classification Search

CPC ..... F04B 37/08; F04B 49/08; F04B 49/065

USPC ..... 62/55.5, 51.1, 56, 100, 268; 417/901

See application file for complete search history.

(56) References Cited

U.S. PATENT DOCUMENTS

| | | | | | |
|---|---|---|---|---|---|
| 3,256,706 | A | * | 6/1966 | Hansen | 62/55.5 |
| 3,485,054 | A | * | 12/1969 | Hogan | 62/55.5 |
| 4,597,420 | A | * | 7/1986 | Schoenthaler et al. | 141/2 |
| 4,910,965 | A | * | 3/1990 | Lepofsky et al. | 62/55.5 |
| 4,964,280 | A | * | 10/1990 | Piunno et al. | 62/78 |
| 5,161,382 | A | * | 11/1992 | Missimer | 62/46.1 |
| 5,513,499 | A | * | 5/1996 | deRijke | 62/55.5 |
| 5,517,823 | A | * | 5/1996 | Andeen et al. | 62/55.5 |
| 5,582,017 | A | * | 12/1996 | Noji et al. | 62/55.5 |
| 5,926,936 | A | * | 7/1999 | Ikeda et al. | 29/460 |
| 6,092,373 | A | * | 7/2000 | Mundinger | 62/55.5 |
| 6,116,032 | A | * | 9/2000 | Mori et al. | 62/55.5 |

(Continued)

FOREIGN PATENT DOCUMENTS

| | | | |
|---|---|---|---|
| JP | S57-146072 | A | 9/1982 |
| JP | 05-099139 | A | 4/1993 |
| JP | H06-229296 | A | 8/1994 |

OTHER PUBLICATIONS

Notification of Reason(s) for Refusal issued in Japanese Application No. 2011-125529, dated Apr. 22, 2014.

*Primary Examiner* — Mohammad M Ali

(74) *Attorney, Agent, or Firm* — Rader, Fishman & Grauer PLLC

(57) ABSTRACT

A cryopump control apparatus controls an evacuation process of a cryopump that includes a cryopanel which cools and thus condenses or adsorbs gas, and a pump housing which contains the cryopanel. The cryopump control apparatus includes a pressure control unit and a vacuum retention evaluation unit. The pressure control unit stops pumping when detecting that a pressure in the pump housing decreases to a reference pressure. The vacuum retention evaluation unit determines whether a difference between pressure values in the pump housing measured at first measurement time and at second measurement time is within an allowable range of pressure change. The first measurement time is determined by adding correction time relating to an operating delay of pumping to a time point when the pressure in the pump housing is detected to be decreased to the reference pressure.

5 Claims, 6 Drawing Sheets

(56) References Cited

U.S. PATENT DOCUMENTS

| | | | | |
|---|---|---|---|---|
| 6,122,920 | A * | 9/2000 | Hill et al. | 62/55.5 |
| 6,122,921 | A * | 9/2000 | Brezoczky et al. | 62/55.5 |
| 6,155,059 | A * | 12/2000 | Matte et al. | 62/55.5 |
| 6,193,811 | B1 * | 2/2001 | Sundarrajan et al. | 134/19 |
| 6,465,965 | B2 * | 10/2002 | Nelson | 315/111.81 |
| 6,755,028 | B2 * | 6/2004 | Gaudet et al. | 62/55.5 |
| 6,996,994 | B2 * | 2/2006 | Wang et al. | 62/6 |
| 7,194,867 | B2 * | 3/2007 | Bartlett et al. | 62/55.5 |
| 2001/0042839 | A1 * | 11/2001 | Haas et al. | 250/492.2 |
| 2003/0014985 | A1 * | 1/2003 | Dresens et al. | 62/149 |
| 2004/0182091 | A1 * | 9/2004 | Wang et al. | 62/55.5 |
| 2004/0194477 | A1 * | 10/2004 | Gaudet et al. | 62/55.5 |
| 2004/0261426 | A1 * | 12/2004 | Amundsen et al. | 62/55.5 |
| 2005/0081536 | A1 * | 4/2005 | Gaudet et al. | 62/55.5 |
| 2005/0196284 | A1 * | 9/2005 | Gaudet et al. | 417/44.1 |
| 2005/0262852 | A1 * | 12/2005 | Amundsen et al. | 62/55.5 |
| 2006/0026968 | A1 * | 2/2006 | Gao | 62/6 |
| 2007/0107448 | A1 * | 5/2007 | Dresens et al. | 62/149 |
| 2008/0267790 | A1 * | 10/2008 | Gaudet et al. | 417/205 |
| 2009/0282842 | A1 * | 11/2009 | Koyama | 62/56 |
| 2011/0016890 | A1 * | 1/2011 | Kimura | 62/55.5 |

* cited by examiner

CRYOPUMP CONTROL APPARATUS, CRYOPUMP SYSTEM, AND METHOD FOR EVALUATING VACUUM RETENTION OF CRYOPUMPS

BACKGROUND OF THE INVENTION

1. Field of the Invention

Technical Field

The present invention generally relates to vacuum technology, and more particularly, to a cryopump control apparatus, a cryopump system, and a method for evaluating vacuum retention of cryopumps.

2. Description of the Related Art

Background Art

A cryopump is a vacuum pump that attains a clean high vacuum environment, and is utilized, for example, to maintain a high vacuum in a vacuum chamber used in a semiconductor circuit manufacturing process. A cryopump accumulates gas by condensing or adsorbing gas molecules on cryopanels cooled to an ultra cold temperature by a refrigerator so as to exhaust gas from a vacuum chamber.

If cryopanels are covered by gases that have been condensed and converted to solid state, or if adsorbents of the cryopump have adsorbed gases almost to its maximum adsorption capacity, the pumping capability of the cryopump decreases. Thus, a regeneration process is executed, as appropriate. In the regeneration process, first the temperature of cryopanels is raised so that the accumulated gases are liquefied or evaporated and discharged, accordingly. Next the cryopump is evacuated and then whether the vacuum is maintained properly (i.e., vacuum retention state) is evaluated. Thereafter, the cryopanels are cooled to an ultra cold temperature so that the cryopump can be used again.

SUMMARY OF THE INVENTION

According to an aspect of the present invention, a cryopump control apparatus is provided. The cryopump control apparatus controls an evacuation process of a cryopump that includes a cryopanel which cools and thus condenses or adsorbs gas, and a pump housing which contains the cryopanel. The cryopump control apparatus includes a pressure control unit, a time managing unit, and a vacuum retention evaluation unit. The pressure control unit stops pumping when detecting that a pressure in the pump housing decreases to a reference pressure. The time managing unit determines first measurement time and second measurement time that is later than the first measurement time. The vacuum retention evaluation unit determines whether a difference between pressure values in the pump housing measured at the first measurement time and at the second measurement time is within an allowable range of pressure change. The first measurement time may be determined by adding correction time relating to an operating delay of pumping to a time point when the pressure in the pump housing is detected to be decreased to the reference pressure.

According to another aspect of the present invention, a cryopump system is provided. The cryopump system includes: a plurality of cryopumps each including a cryopanel that cools and thus condenses or adsorbs gas and, a pump housing that contains the cryopanel; a rough pump configured to pump the pump housing; and a control apparatus that controls an evacuation process of the plurality of cryopumps. The control apparatus includes a pressure control unit, a time managing unit, and a vacuum retention evaluation unit. The pressure control unit stops pumping when detecting that a pressure in the pump housing of a cryopump under an evacuation process decreases to a reference pressure. The time managing unit determines first measurement time and second measurement time that is later than the first measurement time for the cryopump. The vacuum retention evaluation unit determines whether a difference between pressure values in the pump housing measured at the first measurement time and at the second measurement time is within an allowable range of pressure change. The first measurement time may be determined by adding correction time relating to an operating delay of pumping to a time point when the pressure in the pump housing is detected to be decreased to the reference pressure.

According to another aspect of the present invention, a method for evaluating vacuum retention is provided. The method evaluates vacuum retention of a cryopump including a cryopanel that cools and thus condenses or adsorbs gas, and a pump housing that contains the cryopanel. The method includes: instructing to stop pumping when detecting that a pressure in the pump housing decreases to a reference pressure; determining first measurement time and second measurement time that is later than the first measurement time; and determining whether a difference between pressure values in the pump housing measured at the first measurement time and at the second measurement time is within an allowable range of pressure change. The first measurement time may be determined by adding correction time relating to an operating delay of pumping to a time point when the pressure in the pump housing is detected to be decreased to the reference pressure.

Optional combinations of the aforementioned constituting elements, and implementations of the invention in the form of methods, apparatuses, systems, recording mediums, computer programs, or the like may also be practiced as additional modes of the present invention.

DETAILED DESCRIPTION OF THE INVENTION

Mode for Carrying Out the Invention

The invention will now be described by reference to the preferred embodiments. This does not intend to limit the scope of the present invention, but to exemplify the invention.

When checking a vacuum retention state in a cryopump during a regeneration process, typically the cryopump is pumped down to a reference pressure, which is a targeted pressure. Upon detecting that the pressure is decreased to the reference pressure, the pumping is stopped. When a predetermined vacuum retention inspection time has elapsed, the pressure in the cryopump is measured again. If the rise of the pressure from the reference pressure is within an allowable range, it is determined that the vacuum is sufficiently maintained. According to this method, a rate of rise in pressure (pressure rise rate) is substantially checked by comparing two pressure values, that is, the value when the pumping is stopped, and the value when the vacuum retention inspection time has elapsed. If the pressure rise rate is high, a vacuum retention state is considered to be not preferable.

However, there is a time lag between when the pressure in the cryopump is decreased to the reference pressure and when the pumping is stopped actually, the time lag resulting from delay in pressure detection, communication, operation of a valve, or the like. Therefore, pressure in the cryopump is presumed to be pumped down temporarily to a pressure lower than the reference pressure in practice. Since the pressure starts increasing from the pressure lower than the reference pressure, even if the pressure rise rate is high and the vacuum retention state is not preferable, the vacuum retention state may be determined to be within an allowable range by checking a pressure value measured when the vacuum retention inspection time has elapsed, according to the determination based on a view point of the pressure rise from the reference pressure. Thus, the present inventor recognizes that a vacuum retention state may sometimes be determined inaccurately according to the method described above.

One of exemplary purposes of an embodiment of the present invention is to provide a cryopump control apparatuses, a cryopump system, and a method for testing vacuum retention of a cryopump.

Figure 1:
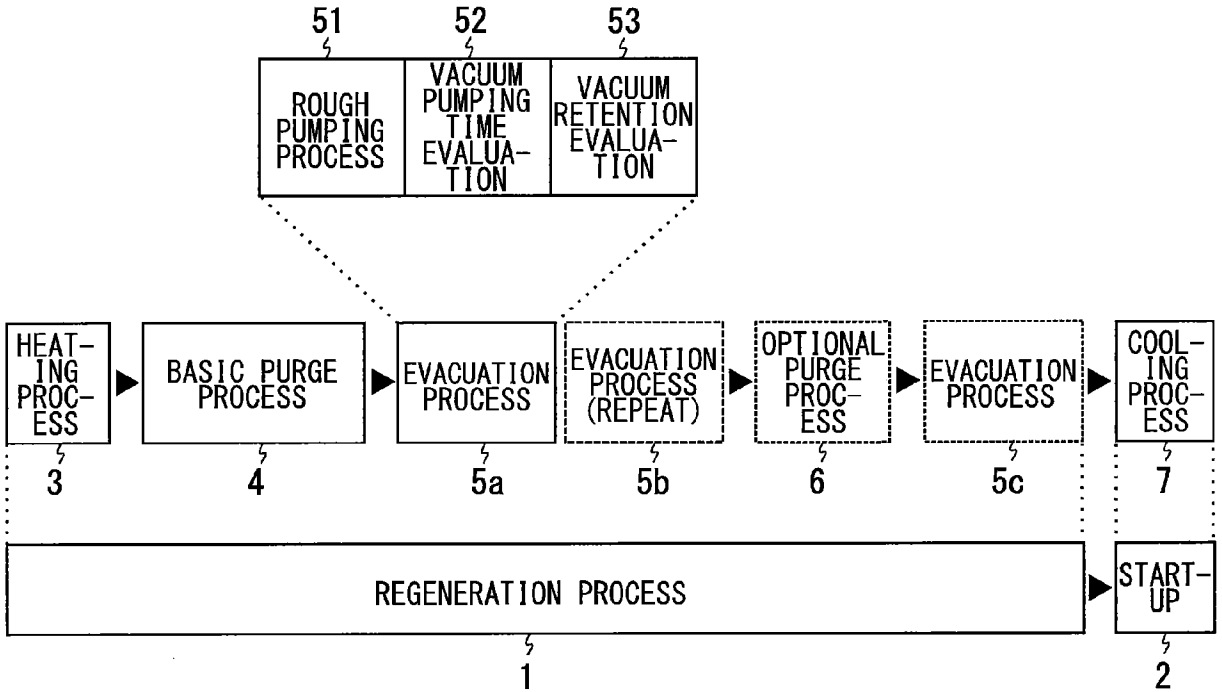
FIG. 1 shows a regeneration process and a start-up process of a cryopump according to an exemplary embodiment.

First, a general description will be given on an exemplary embodiment. FIG. 1 shows a regeneration process 1 and a start-up process 2 of a cryopump according to an exemplary embodiment. The regeneration process 1 includes a heating process 3, a purge process, and an evacuation process 5. In the heating process 3, gases accumulated in the cryopump are liquefied or evaporated. In the purge process, a gas used for purging (herein after also referred to as a "purge gas"), such as a nitrogen gas or the like, is introduced in order to facilitate the disengagement of gases condensed or adsorbed on cryopanels. In the evacuation process, a purge gas or re-evaporated gases are exhausted from the cryopump. The purge process includes a basic purge process 4, which should be executed in every regeneration process in principle, and an optional purge process 6, which is executed as necessary after the basic purge process.

In case that a state after each process is determined not to satisfy a certain condition, the same process is executed repeatedly, or an additional process is executed. Processes shown with dashed line in FIG. 1 are executed only if necessary.

After the basic purge process 4 and after the optional purge process 6, an evacuation process 5 is executed, respectively. The evacuation process 5 includes a rough pumping process 51, a vacuum pumping time evaluation 52, and a vacuum retention evaluation 53. In the rough pumping process 51, the cryopump is evacuated. By the vacuum pumping time evaluation 52, it is determined whether the cryopump is pumped down to the reference pressure within a predetermined time period after starting pumping. By the vacuum retention evaluation 53, it is determined whether rise of pressure when a predetermined time period has passed after the stop of the pumping is within an allowable range. In case that a further evacuation process 5 is determined to be required as the result of the vacuum retention evaluation 53, the evacuation process 5 is executed once more. In the example shown in FIG. 1, an evacuation process 5*a* and an evacuation process 5*b* are executed after the basic purge process 4, and an evacuation process 5*c* is executed after the optional purge process 6. In the description, each of the evacuation processes 5*a*-5*c* is also collectively referred to as a "evacuation process 5."

If the evacuation process 5 has completed, the regeneration process 1 is over, and the cryopump can be used again after the start-up process 2 including the cooling process 7 in which the cryopanels are cooled.

The cryopump control apparatus according to an exemplary embodiment performs a vacuum retention evaluation 53 during the evacuation process 5. This cryopump control apparatus defines a time point to start the vacuum retention evaluation 53 separately from the time point when the pressure in the cryopump is detected to be decreased to a predetermined reference pressure and determines a measured pressure value at that time point as an initial value used for the vacuum retention evaluation 53, separately from the reference pressure. The cryopump control apparatus compares a pressure value measured when a predetermined vacuum retention inspection time has elapsed after the start of the vacuum pumping time evaluation 52 with the initial value so as to evaluate the vacuum retention state, accordingly.

Figure 2:
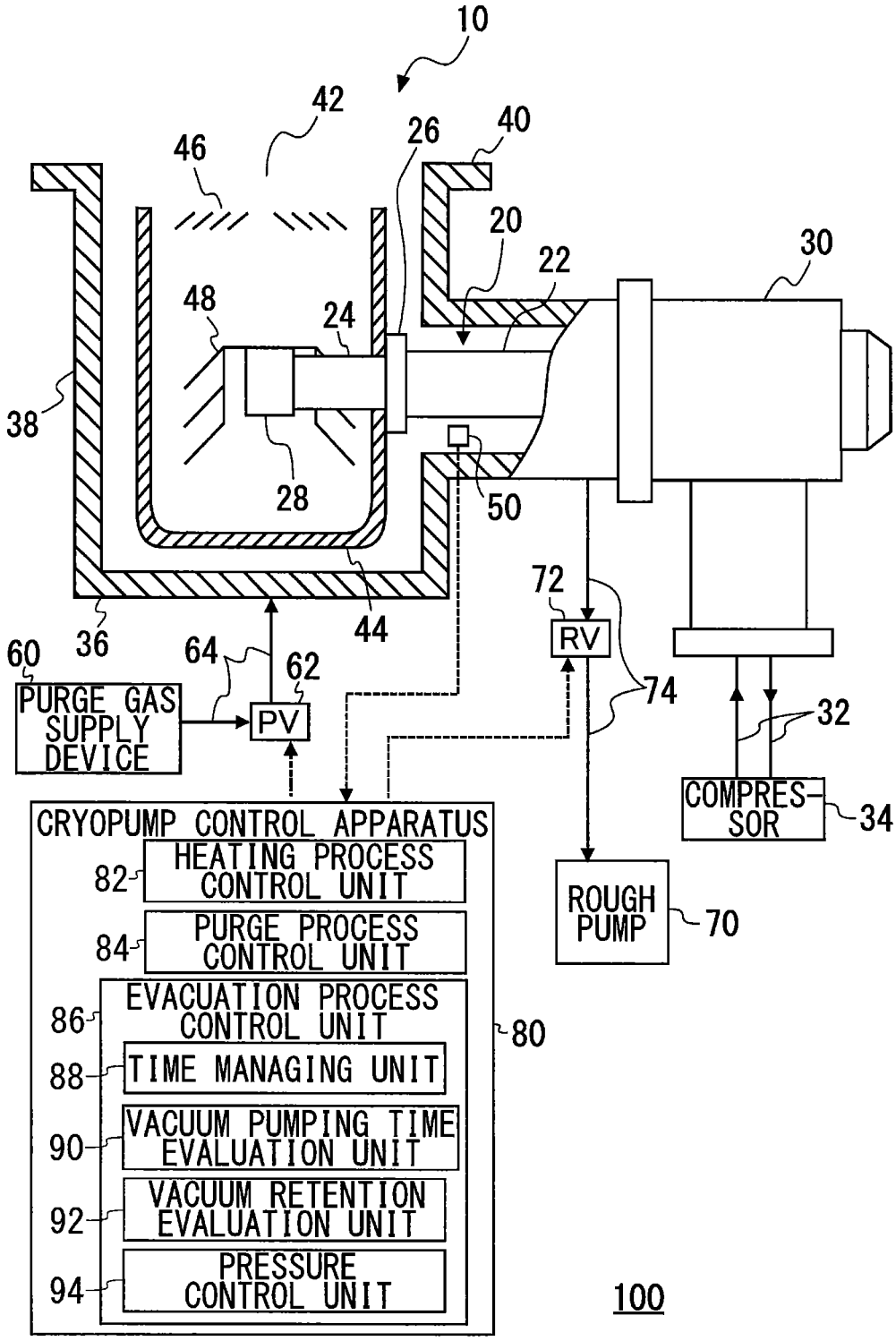
FIG. 2 schematically shows a cryopump according to an exemplary embodiment.

A detailed explanation will be given below. FIG. 2 schematically shows a cryopump system 100 according to an exemplary embodiment. The cryopump system 100 comprises a cryopump 10, a compressor 34, a purge gas supply device 60, a rough pump 70, and a cryopump control apparatus 80. The cryopump 10 is mounted to a vacuum chamber of, for example, an ion implantation apparatus, a sputtering apparatus, or the like and used to increase the vacuum level inside the vacuum chamber to a level required by a desired process. The cryopump 10 includes a pump housing 36, a radiation shield 44, a cryopanel 48, and a refrigerator 20.

The refrigerator 20 is, for example, a Gifford-McMahon refrigerator (so-called GM refrigerator) or the like. The refrigerator 20 is provided with a first cylinder 22, a second cylinder 24, a first cooling stage 26, a second cooling stage 28, and a valve drive motor 30. The first cylinder 22 and the second cylinder 24 are connected in series. The first cooling stage 26 is installed on one end of the first cylinder 22 where the first cylinder 22 is connected with the second cylinder 24. The second cooling stage 28 is installed on the second cylinder 24 at the end that is farthest from the first cylinder 22. The refrigerator 20 shown in FIG. 2 is a two-stage refrigerator and achieves lower temperature by combining two cylinders in series. The refrigerator 20 is connected to a compressor 34 through a refrigerant pipe 32.

The compressor 34 compresses a refrigerant gas (i.e., an operating gas) such as helium or the like, and supplies the gas to the refrigerator 20 through the refrigerant pipe 32. While cooling the operating gas by allowing the gas to pass through a regenerator, the refrigerator 20 further cools the gas by expanding the gas first in an expansion chamber inside the first cylinder 22 and then in an expansion chamber in the second cylinder 24. Regenerators are installed inside the expansion chambers. Thereby, the first cooling stage 26 installed on the first cylinder 22 is cooled to a first cooling temperature level while the second cooling stage 28 installed on the second cylinder 24 is cooled to a second cooling temperature level lower than the first cooling temperature level. For example, the first cooling stage 26 is cooled to about 65-100 K, while the second cooling stage 28 is cooled to about 10-20 K.

The operating gas, which has absorbed heat by expanding in the respective expansion chambers sequentially and cooled respective cooling stages, passes through the regenerator again and is returned to the compressor 34 through the refrigerant pipe 32. The flow of the operating gas from the compressor 34 to the refrigerator 20 and from the refrigerator 20 to the compressor 34 is switched by a rotary valve (not shown)

in the refrigerator 20. A valve drive motor 30 rotates the rotary valve with power supplied from an external power source.

The pump housing 36 has a portion 38 formed into a cylindrical shape (hereinafter, referred to as a "trunk portion 38"), one end of which being provided with an opening and the other end being closed. The opening of a pump housing 36, that is, a pump inlet 42 accepts a gas to be evacuated from a vacuum chamber of a vacuum apparatus to which the cryopump is to be connected. The pump inlet 42 is defined by the interior surface of the upper end of the trunk portion 38 of the pump housing 36.

At the upper end of the trunk portion 38 of the pump housing 36, a mounting flange 40 extends outwardly in the radial direction. The cryopump 10 is mounted, by using the mounting flange 40 via a gate valve (not shown), to the vacuum chamber of the vacuum apparatus.

The pump housing 36 separates the inside of the cryopump 10 from the outside thereof. The pump housing 36 is airtight and the inside thereof is maintained at a common pressure. This allows the pump housing 36 to function as a vacuum vessel during the cryopump 10 operates to discharge gas. The exterior surface of the pump housing 36 is exposed to the environment outside the cryopump 10 during the operation of the cryopump 10, i.e., even during cooling operation of the refrigerator. Therefore the exterior surface of the pump housing 36 is maintained at a temperature higher than that of the radiation shield 44. The temperature of the pump housing 36 is typically maintained at an ambient temperature.

A pressure sensor 50 is provided in the pump housing 36. The pressure sensor 50 measures, periodically or when receiving an instruction, the internal pressure of the pump housing 36 and transmits a signal indicating the measured pressure to the cryopump control apparatus 80. The pressure sensor 50 and the cryopump control apparatus 80 are communicably connected with each other.

The pressure sensor 50 has a wide measurement range including both a high vacuum level attained by the cryopump 10 and the atmospheric pressure level. At least a pressure range, which can occur during a regeneration process 1, is included in the measurement range of the pressure sensor 50. Alternatively, a pressure sensor for measuring a vacuum level and that for measuring an atmospheric pressure level may be provided in the cryopump 10, separately.

The radiation shield 44 is arranged inside the pump housing 36. The radiation shield 44 has a cylindrical shape, one end of which being provided with an opening and the other end being closed, that is, a cup-like shape. The trunk portion 38 of the pump housing 36 and the radiation shield 44 have substantially cylindrical shapes and are arranged concentrically. The inner diameter of the trunk portion 38 of the pump housing 36 is larger than the outer diameter of the radiation shield 44 to some extent. Therefore, the radiation shield 44 is arranged in the trunk portion 38 of the pump housing 36 without contact, spaced reasonably apart from the interior surface of the pump housing 36. That is, the outer surface of the radiation shield 44 faces the inner surface of the pump housing 36.

The radiation shield 44 is provided as a radiation shield to protect both the second cooling stage 28 and the cryopanel 48, which is thermally connected to the second cooling stage 28, from radiation heat mainly from the pump housing 36. The second cooling stage 28 is arranged inside the radiation shield 44, substantially on the central axis of the radiation shield 44. The radiation shield 44 is fixed to the first cooling stage 26 so as to be thermally connected to the stage, and the radiation shield 44 is cooled to a temperature comparable to that of the first cooling stage 26.

The cryopanel 48 includes a plurality of panels, each of the panels having a shape of the side surface of a truncated cone. The cryopanel 48 is thermally connected to the second cooling stage 28. Typically, an adsorbent such as activated charcoal or the like (not shown) is attached to the back surface (i.e., the surface further from the pump inlet 42) of respective panels of the cryopanel 48.

A baffle 46 is provided at the opening end of the radiation shield 44 in order to protect both the second cooling stage 28 and the cryopanel 48, which is thermally connected to the stage 28, from radiation heat emitted from a vacuum chamber or the like. The baffle 46 is formed as, for example, a louver structure or a chevron structure. The baffle 46 is thermally connected to the radiation shield 44 and cooled to a temperature comparable to that of the radiation shield 44.

The cryopump control apparatus 80 controls the refrigerator 20 based on the cooling temperature of the first cooling stage 26 or the second cooling stage 28. For this purpose, a temperature sensor (not shown) may be provided on the first cooling stage 26 or on the second cooling stage 28. The cryopump control apparatus 80 may control the cooling temperature by controlling the driving frequency of the valve drive motor 30. The cryopump control apparatus 80 also controls respective valves, which will be described later.

The pump housing 36 and the rough pump 70 are connected by a rough pipe 74. A rough valve 72 is provided in the rough pipe 74. The cryopump control apparatus 80 controls opening or closing of the rough valve 72 so as to open the passage through between the rough pump 70 and the cryopump 10 or to block the passage, respectively. The rough pump 70 is used in order to roughly evacuate the pump housing 36, for example as a preparation for starting pumping by the cryopump. By opening the rough valve 72 and by allowing the rough pump 70 to operate, the pump housing 36 can be evacuated by the rough pump 70.

The pump housing 36 and the purge gas supply device 60, which provides a gas used for purging, such as a nitrogen gas or the like, are connected by a purge gas pipe 64. A purge valve 62 is provided in the purge gas pipe 64. The opening or closing of the purge valve 62 is controlled by the cryopump control apparatus 80. By the opening or closing of the purge valve 62, the supply of the purge gas to the cryopump 10 is controlled.

The pump housing 36 may be connected to a vent valve (not shown) that functions as a so-called safety valve. The rough valve 72 and the purge valve 62 may be provided in the pump housing 36 at a location where the rough pipe 74 or the purge gas pipe 64 is connected with the pump housing 36.

When about to start the pumping operation of the cryopump 10, before starting the operation, pump housing 36 is first pumped by the rough pump 70 through the rough valve 72 down to about 1 Pa. The pressure is measured by the pressure sensor 50. Thereafter, the cryopump 10 is activated. By driving the refrigerator 20 under the control of the cryopump control apparatus 80, the first cooling stage 26 and the second cooling stage 28 are cooled, thereby the radiation shield 44, the baffle 46, and the cryopanel 48, which are thermally connected to the stages, are also cooled.

The cooled baffle 46 cools gas molecules flowing from the vacuum chamber into the cryopump 10 so that a gas whose vapor pressure is sufficiently low at the cooling temperature (e.g., water vapor or the like) will be condensed on the surface of the baffle 46. A gas whose vapor pressure is not sufficiently low at the cooling temperature of the baffle 46 enters into the radiation shield 44 through the baffle 46. Of the entering gas molecules, a gas whose vapor pressure is sufficiently low at the cooling temperature of the cryopanel 48 will be condensed on the surface of the cryopanel 48. A gas whose vapor pressure is not sufficiently low at the cooling temperature (e.g., hydrogen or the like) is adsorbed by an adsorbent, which adheres to the surface of the cryopanel 48 and is cooled. In this way, the cryopump 10 attains a desired degree of vacuum in a vacuum chamber to which the cryopump 10 is mounted.

The regeneration process 1 of the cryopump 10 is executed if a predetermined time period has been passed after starting a pumping operation or if deterioration of performance resulting from the accumulation of exhausted gas on the cryopanel 48 is observed.

The regeneration process 1 of the cryopump 10 is controlled by the cryopump control apparatus 80. The cryopump control apparatus 80 comprises a heating process control unit 82, a purge process control unit 84, and an evacuation process control unit 86.

When about to start the regeneration process 1 of the cryopump 10, the heating process control unit 82 stops the cooling operation of the refrigerator 20 and start a heating operation. The heating process control unit 82 rotates the rotary valve in the refrigerator 20 in a reverse direction from that of the cooling operation so as to differentiate timings of intake and discharge of operating gas from those of the cooling operation in order to cause adiabatic compression to the operating gas. Compression heat obtained in this manner heats the cryopanel 48. The heating process control unit 82 acquires a measured value of the temperature in the pump housing 36 from a temperature sensor (not shown) provided in the cryopump 10. If the measured value reaches to a regeneration temperature, the heating process control unit 82 completes the heating process 3.

The purge process control unit 84 switches opening/closing of the purge valve 62 and the rough valve 72 and executes a basic purge process 4, and if necessary, an optional purge process 6. During the basic purge process 4 and the optional purge process 6, a gas purge step, which introduces a purge gas into the pump housing 36 may be executed once, or a plurality of gas purge steps may be executed while executing a rough-pumping step between the gas purge steps. By the rough-pumping step, gas in the cryopump 10 is evacuated.

After the purge process is completed, the evacuation process control unit 86 executes an evacuation process 5. The evacuation process control unit 86 comprises, a time managing unit 88, a vacuum pumping time evaluation unit 90, a vacuum retention evaluation unit 92, and a pressure control unit 94.

The pressure control unit 94 opens the rough valve 72 and allows the rough pump 70 to start evacuating the pump housing 36. The pressure control unit 94 acquires a pressure value measured in the pump housing 36 from the pressure sensor 50. The vacuum pumping time evaluation unit 90 determines whether the pump housing 36 is pumped down to a reference pressure within a predetermined vacuum pumping measurement time after starting the evacuation. The reference pressure is, for example, a pressure where a start-up process 2 for the cryopump 10 can be started. In this case, the reference pressure may be for example about 1-50 Pa. In case that a measured pressure value that is equal to or less than the reference pressure is acquired during the vacuum pumping measurement time, the vacuum pumping time evaluation unit 90 determines that a vacuum pumping time condition is satisfied, and the pressure control unit 94 closes the rough valve 72 and stops pumping, accordingly.

On the other hand, in case that the pressure value measured in the pump housing 36 remains higher than the reference value even after the vacuum pumping measurement time has elapsed, the vacuum pumping time evaluation unit 90 determines that the vacuum pumping time condition is not satisfied, and the purge process control unit 84 executes an optional purge process 6, accordingly.

In case that the vacuum pumping time condition is met, a vacuum retention evaluation 53 is executed, subsequently. The time managing unit 88 determines first measurement time and second measurement time that determine a time point indicating when to measure a pressure value that is used for a vacuum retention evaluation. The first measurement time is determined by adding correction time relating to an operating delay of pumping to a time point when the pressure control unit 94 detects a measurement pressure value less than or equal to the reference pressure for the first time in an evacuation process 5, so that the first measurement time is close to a time point when pumping is stopped actually.

The correction time relating to an operating delay of pumping is added in order to bring the first measurement time close to a time point when the pump housing is pumped down to the lowest level. The correction time may be for example 1-5 seconds. The correction time relating to an operating delay of pumping compensates time expected to be required after the detection of the decrease to the reference pressure until the stop of pumping, for example time required for a determination by the vacuum pumping time evaluation unit 90, time required for an instruction to stop pumping by the pressure control unit 94, time required for an operation of the rough valve 72, etc. The correction time may be determined based on experience or by experiment since the correction time may differ depending on models of devices, connection statuses, layouts, etc.

The time managing unit 88 adds vacuum retention inspection time to the first measurement time, and determines the second measurement time, accordingly. The vacuum retention inspection time is time required to detect a significant pressure difference during the vacuum retention evaluation 53 in case that gas has not been sufficiently disengaged by the regeneration process, and is for example, about 1-10 minutes. The vacuum retention inspection time may be determined based on experience or by experiment since an optimal vacuum retention inspection time may vary depending on reference pressures or models of devices.

The first measurement time may be determined as a time point when a minimum pressure value is acquired among pressure values measured in the pump housing 36, which are acquired a plurality of times after the pressure control unit 94 stops the pumping. In this case, a time period from when the pressure control unit 94 detects a measured pressure value less than or equal to the reference pressure to the first measurement time is the correction time relating to an operating delay of pumping.

Figure 3:
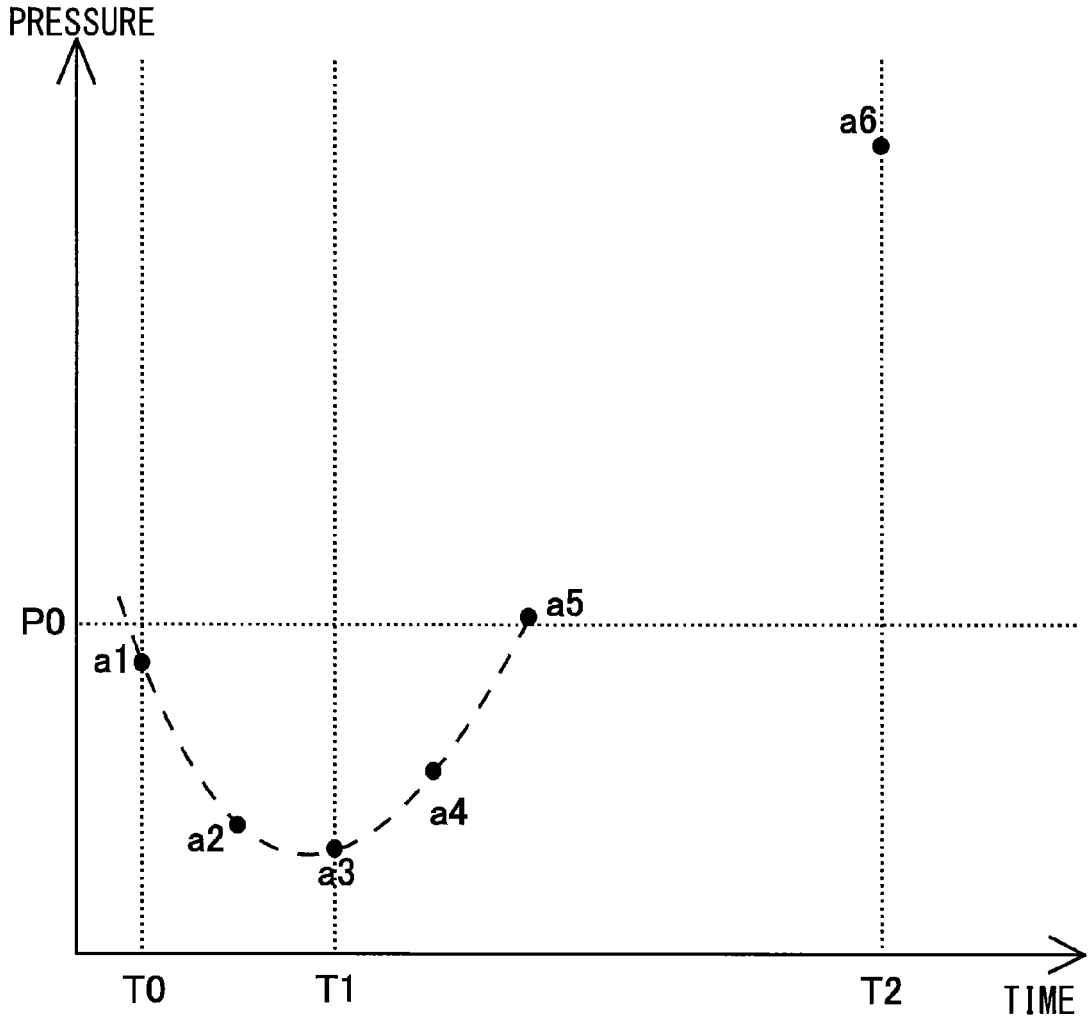
FIG. 3 shows am example of a method for determining first measurement time in an evacuation process of a regeneration process of the cryopump.

FIG. 3 shows am example of a method for determining the first measurement time. In FIG. 3, the horizontal axis indicates time and the vertical axis indicates the pressure in the pump housing 36. After the measured pressure value a1 reaches less than the reference pressure P0 at time T0, pressure values in the pump housing 36 are acquired four times in total, from a2 to a5 at predetermined time intervals.

In case that a given measurement pressure value is less than the values measured before and after, the time managing unit 88 determines the time when the given measurement pressure value is measured as the first measurement time.

That is, when the i-th measurement pressure value is represented by a(i), if both inequalities (1) and (2) are satisfied, a(n) is determined to be the minimum value and the time when the pressure value a(n) is measured is determined to be the first measurement time.

$$a(n)-a(n-1)<0 \quad (1)$$

$$a(n+1)-a(n)>0 \quad (2)$$

where "n" represents a positive integer more than one.

In addition to the conditions (1) and (2), the inequality (3) below may also defined as a condition to be met to determine the first measurement time as the time when the pressure value a(n) is measured.

$$a(n+2)-a(n+1)>0 \quad (3)$$

This eliminates noise data for example in case a pseudo minimum pressure value is acquired temporarily due to measurement errors or the like. Thus, a time point when the pressure reaches its minimum can be detected more accurately. In this case, that a(n+1)−a(n) is more than or equal to zero may be defined as a condition instead of the inequality (2). Thereby, a point where the pressure reaches its minimum can be detected even in case same values are acquired as successive measurement values. Further, in case that a(n+1)−a(n) equals 0, a midpoint between the time when the pressure value a(n) is measured and the time when the pressure value a(n+1) is measured may be determined as the first measurement time. This enables more accurate determination of the vacuum retention state.

In FIG. 3, a3−a2<0, a4−a3>0, and a5−ab4>0 are satisfied. Therefore, the time managing unit 88 determines the pressure value a3 as the minimum value and the time T1 when the pressure value a3 is measured as the first measurement time. In this case, time period T1-T0 corresponds the correction time relating to an operating delay of pumping.

As shown in FIG. 3 with dashed line, a plurality of acquired measurement pressure values may be used, an appropriate function (e.g., a quadratic function, or the like) may be determined for example by a least square method, and a time point when the function reaches its minimum may be determined as the first measurement time. Thereby, the first measurement time can be determined by estimating a time point when the pressure reaches its minimum even in case where determination of the minimum value by comparison of successive measurement values is difficult, for example in case that measured pressure values fluctuate, etc.

The pressure control unit 94 acquires from the pressure sensor 50 pressure values measured in the pump housing 36 at the first measurement time and at the second measurement time. The vacuum retention evaluation unit 92 determines whether a difference between the pressure values measured at the first measurement time and at the second measurement time is within an allowable range of pressure change. In the example shown in FIG. 3, the vacuum retention evaluation unit 92 determines whether the difference between the pressure value a3 measured at the first measurement time T1 and the pressure value a6 measured at the second measurement time T2 is within an allowable range of pressure change.

The allowable range of pressure change is a range of pressure change that can substantially eliminate a risk of insufficient disengagement of gases during regeneration process, or a risk of leakage. The allowable range of pressure change is determined, for example within the range of 1-50 Pa. The allowable range of pressure change may be determined based on experience or by experiment since an optimal allowable range of pressure change may vary depending on reference pressures or models of devices.

In case that the difference between the pressure values measured at the first measurement time and at the second measurement time is within the allowable range of pressure change, the vacuum retention evaluation unit 92 determines that a vacuum retention condition is satisfied, and completes the evacuation process 5, accordingly. If the evacuation process 5 has completed, the regeneration process 1 ends, and the cooling process 7 of the start-up process 2 of the cryopump 10 is started. In case that the difference between the pressure values measured at the first measurement time and at the second measurement time is beyond the allowable range of pressure change by the vacuum retention evaluation 53, the vacuum retention evaluation unit 92 determines that a vacuum retention condition is not satisfied. In this case, the evacuation process 5 is executed once more.

The purge process control unit 84 determines whether or not the optional purge process 6 is required. More specifically, the purge process control unit 84 determines to execute the optional purge process 6 in case that a sequential evacuation process execution number, which is the number of times that the evacuation process 5 is executed repeatedly in sequence, reaches to an additional purge requiring criteria number, which is determined in advance.

In case that a small amount of remained gases are attached to the cryopanel 48 even after the execution of a basic purge process 4 and an evacuation process 5, the remained gases can be exhausted from the cryopump 10 by repeating the evacuation process 5 several times. However, in case that a large amount of remained gases are attached to the cryopanel 48, or the gases are attached in a state difficult to disengage, the remained gases can be often exhausted quicker with one time execution of the optional purge process 6 than repeating the evacuation process 5 several times.

The additional purge requiring criteria number is determined so that an average time required for the regeneration process 1 becomes shorter. For example, the additional purge requiring criteria number may be determined within the range of 1-20 times. The additional purge requiring criteria number may be determined based on experience or by experiment since an optimal additional purge requiring criteria number may vary depending on usage statuses of the cryopump 10, types of gases to be exhausted, or the like.

Figure 4:
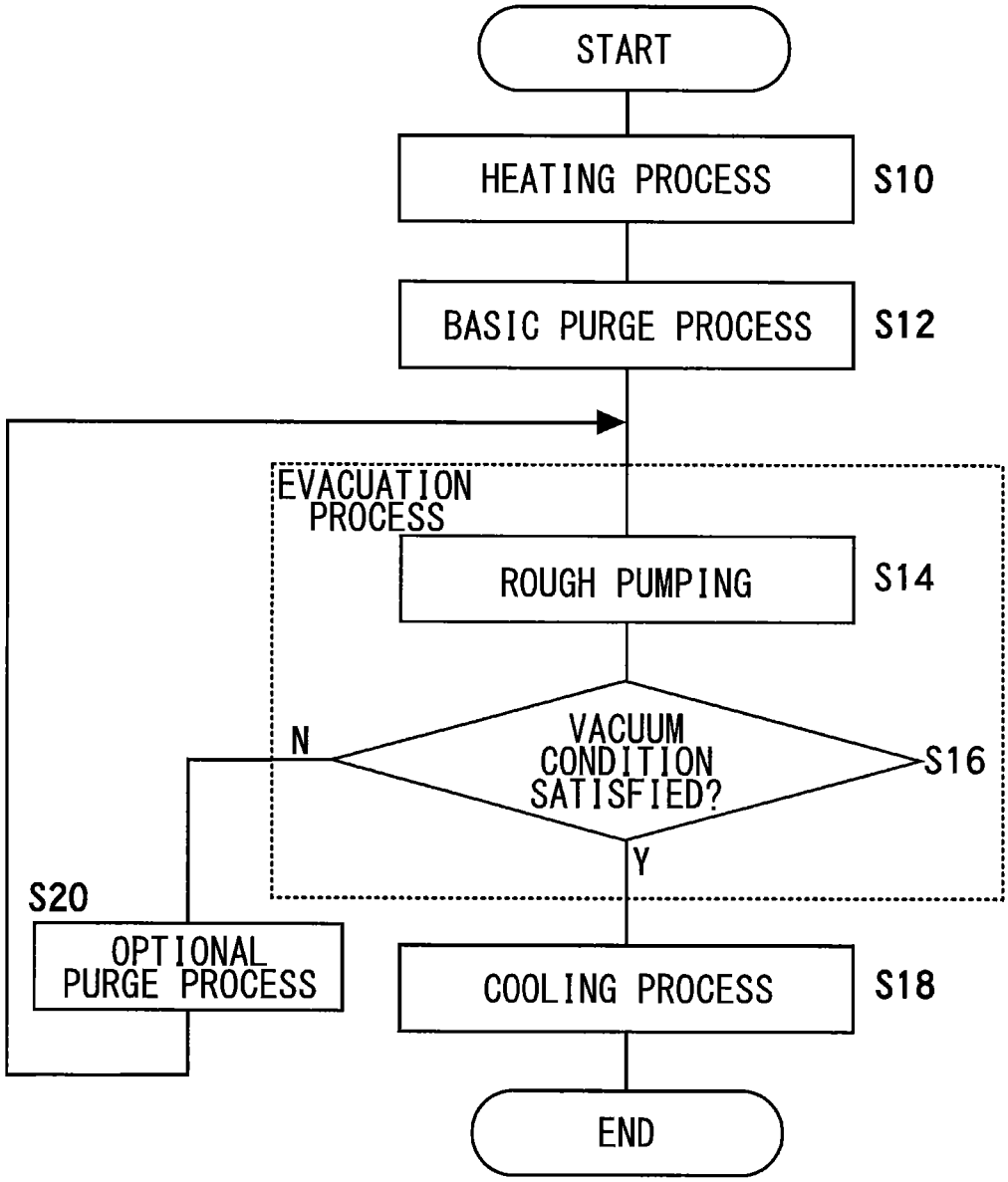
FIG. 4 shows a regeneration process and a subsequent start-up process of the cryopump.

An explanation on the operation with the aforementioned configuration will be given below. FIG. 4 shows a regeneration process 1 and a subsequent start-up process 2 of the cryopump 10. First, the heating process control unit 82 executes the heating process 3 (S10), and then the purge process control unit 84 executes the basic purge process 4 (S12).

The evacuation process control unit 86 executes the evacuation process 5 thereafter. The evacuation process 5 includes a rough pumping process 51 and a vacuum condition evaluation. In the rough pumping process 51, the cryopump 10 is evacuated (S14). By the vacuum condition evaluation, whether the evacuation process 5 is completed is determined (S16) by the vacuum pumping time evaluation 52 and the vacuum retention evaluation 53. In case that the vacuum condition is not satisfied (N in S16), the purge process control unit 84 executes an optional purge process 6 (S20). Then the evacuation process 5 is executed again (S14 and S16). In case that the vacuum condition is satisfied (Y in S16), the evacuation process 5 completes. Accordingly, the refrigerator 20 starts cooling operation and cools the cryopanel 48 again (S18). If the cooling process 7 has completed, the pumping operation of the cryopump 10 can be started again.

Figure 5:
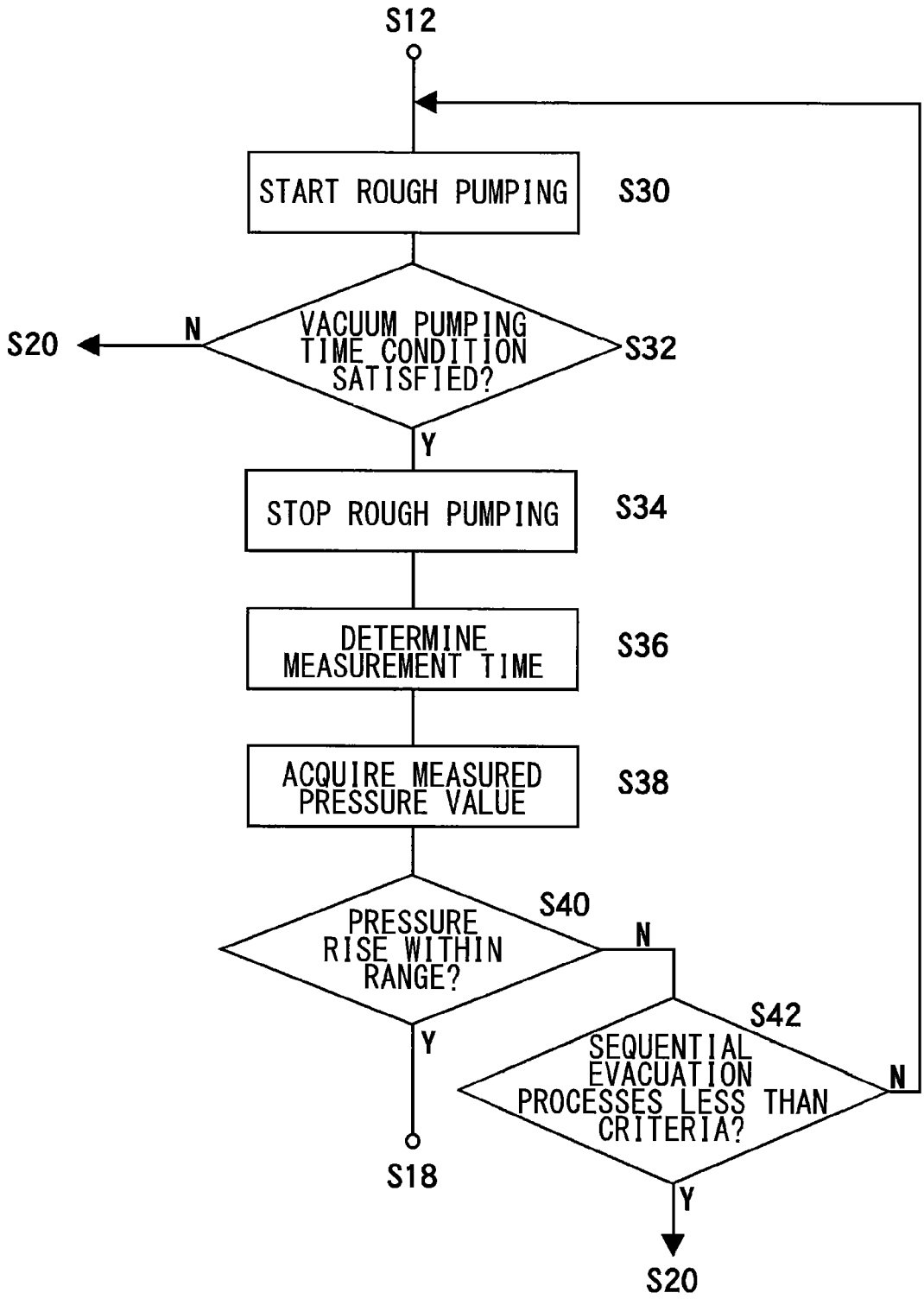
FIG. 5 shows an evacuation process of the regeneration process of the cryopump in detail.

FIG. 5 shows an evacuation process 5 of the regeneration process 1 of the cryopump 10 according to an exemplary embodiment in detail. The pressure control unit 94 opens the rough valve 72 and allows the rough pump 70 to start pumping the pump housing 36 in order to discharge a purge gas or gases re-evaporated by the purge process from the cryopump 10 (S30). The vacuum pumping time evaluation unit 90 executes the vacuum pumping time evaluation 52, which determines whether the pump housing 36 is pumped down to a reference pressure within a predetermined vacuum pumping measurement time (S32).

In case the vacuum pumping time evaluation unit 90 determines that the vacuum pumping time condition is not satisfied (N in S32), the purge process control unit 84 executes an optional purge process 6 (S20 in FIG. 4). In case the vacuum pumping time evaluation unit 90 determines that the vacuum pumping time condition is satisfied (Y in S32), the pressure control unit 94 closes the rough valve 72 and stops the pumping (S34).

Subsequently, the vacuum retention evaluation 53 is executed. The time managing unit 88 determines first measurement time and second measurement time when a pressure value that is used for a vacuum retention evaluation 53 is to be measured (S36). The pressure control unit 94 acquires pressure values in the pump housing 36 measured at the first measurement time and at the second measurement time (S38). The vacuum retention evaluation unit 92 determines whether a difference between the measured pressure values is within the allowable range of pressure change (S40).

In case that the difference is beyond the allowable range of pressure change, the vacuum retention evaluation unit 92 determines that a vacuum retention condition is not satisfied (N in S40). In this case, the purge process control unit 84 determines whether or not the optional purge process 6 is required based on the sequential execution number of the evacuation process 5 (S42). In case that the sequential execution number of the evacuation process 5 has not reached the additional purge requiring criteria number (N in S42), the purge process control unit 84 determines not to execute an optional purge process 6, and the evacuation process control unit 86 executes the evacuation process 5 once more (S30). On the other hand, in case that the sequential execution number of the evacuation process 5 has reached the additional purge requiring criteria number (Y in S42), the purge process control unit 84 executes an optional purge process 6 (S20).

In case the vacuum retention evaluation unit 92 determines that the vacuum retention condition is satisfied (Y in S40), the evacuation process control unit 86 completes the evacuation process 5. Thereby the regeneration process 1 completes, and the cooling process 7 of the start-up process 2 of the cryopump 10 is executed (S18 in FIG. 4).

In this manner, according to the present exemplary embodiment, a time lag resulting from delay in pressure detection, communication, operation of a valve, or the like can be compensated and thus the vacuum retention evaluation 53 can be executed more accurately.

The present invention may be implemented in the manner described below. A method for evaluating whether a pressure change in a pump housing of a cryopump comprising a cryopanel that cools and thus condenses or adsorbs gas and the pump housing that contains the cryopanel is within an allowable range, wherein as an initial value of pressure that serves as a reference value for checking the pressure change, a pressure value that is further decreased after stopping pumping is adopted rather than a target pressure to stop pumping.

Given above is an explanation based on the exemplary embodiment. The exemplary embodiment described above is intended to be illustrative only and it will be obvious to those skilled in the art that various modifications could be developed and that such modifications are also within the scope of the present invention.

Figure 6:
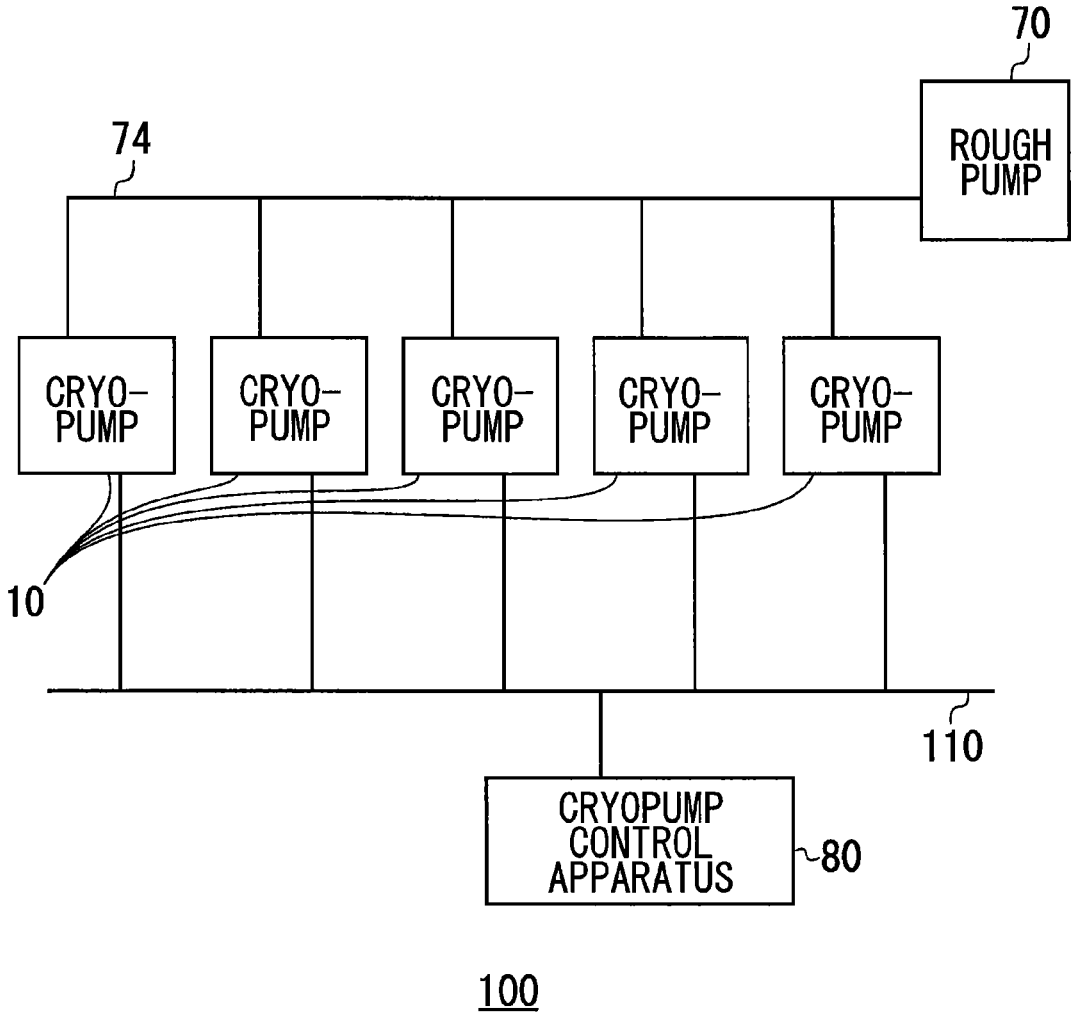
FIG. 6 shows a variation of a cryopump system.

According to an exemplary embodiment, an explanation has been given on an example where the cryopump control apparatus 80 controls the evacuation process 5 during a regeneration process of one cryopump 10. However, the cryopump control apparatus 80 may control evacuation processes 5 of a plurality of cryopumps 10. FIG. 6 shows a variation of the cryopump system 100. For the aforementioned constituting elements, a same referential number is attached also in FIG. 6, and the explanation thereof is omitted. The cryopump system 100 comprises a plurality of cryopumps 10, a cryopump control apparatus 80, and a rough pump 70. The plurality of cryopumps 10 and the rough pump 70 are connected by a rough pipe 74.

The cryopump control apparatus 80 and the cryopumps 10 are communicably connected via a cable or a network 110, such as, an intranet, a local area network (LAN), a wide area network (WAN), a virtual private network (VPN), the Internet, or the like.

In the cryopump system 100 of FIG. 6, the pressure control unit 94 controls the rough valves 72 of respective cryopumps 10, and pumps one cryopump 10 at a time by opening the rough valve 72 of the cryopump 10. The effective pumping rate by the rough pump 70 at each cryopump 10 is determined by the pumping capability of the rough pump 70, the conductance of gas flowing through the rough pipe 74, or the like. Particularly under a low pressure, the effective pumping rate is susceptible to the length of a pipe and the radius of the pipe.

More specifically, it is known that the shorter a pipe between the rough pump 70 and a cryopump 10 is, the higher the effective pumping rate for the cryopump 10 by the rough pump 70 is. Thus, the pump housing 36 of a cryopump 10 with a shorter pipe is presumed to be pumped down to a lower pressure comparing to that of other cryopumps 10, during a time lag between the detection of the reference pressure in the evacuation process 5 and the stop of pumping. In case of adopting the reference pressure as an initial pressure value of vacuum retention evaluation 53 as often adopted with conventional systems, the number of erroneous determination might increase especially for a cryopump 10 with a shorter pipe to the rough pump 70.

The cryopump control apparatus 80 according to the exemplary embodiment performs the evacuation process 5 described above for respective cryopumps 10. The time managing unit 88 determines correction time relating to an operating delay of pumping, first measurement time, and second measurement time separately for each cryopump 10. Thereby, in the cryopump system 100 comprising the plurality of cryopumps 10, the vacuum retention evaluation 53 can be executed more accurately by reflecting conditions different for respective cryopumps 10, such as placement or the like.

It should be understood that the invention is not limited to the above-described embodiment, but may be modified into various forms on the basis of the spirit of the invention. Additionally, the modifications are included in the scope of the invention.

Priority is claimed to Japanese Patent Application No. 2011-125529, filed Jun. 3, 2011, the entire content of which is incorporated herein by reference.

What is claimed is:

1. A cryopump control apparatus controlling an evacuation process of a cryopump that comprises a cryopanel which cools and thus condenses or adsorbs gas, and a pump housing which contains the cryopanel, comprising:

a pressure control unit operative to stop pumping when detecting that a pressure in the pump housing decreases to a reference pressure;

a time managing unit operative to determine first measurement time and second measurement time that is later than the first measurement time; and a vacuum retention evaluation unit operative to determine whether a difference between pressure values in the pump housing measured at the first measurement time and at the second measurement time is within an allowable range of pressure change, wherein the first measurement time is determined by adding correction time relating to an operating delay of pumping to a time point when the pressure in the pump housing is detected to be decreased to the reference pressure.

2. The cryopump control apparatus according to claim 1, wherein the time managing unit compares measurement pressure values in the pump housing acquired a plurality of times after the pressure control unit stops pumping, and determines the first measurement time as a time point when a minimum pressure value among the measurement pressure values is measured.

3. A cryopump system comprising:

a plurality of cryopumps each comprising a cryopanel that cools and thus condenses or adsorbs gas and, a pump housing that contains the cryopanel;

a rough pump configured to pump the pump housing; and a control apparatus operative to control an evacuation process of the plurality of cryopumps, wherein the control apparatus comprises:

a pressure control unit operative to stop pumping when detecting that a pressure in the pump housing of a cryopump under an evacuation process decreases to a reference pressure;

a time managing unit operative to determine first measurement time and second measurement time that is later than the first measurement time for the cryopump; and a vacuum retention evaluation unit operative to determine whether a difference between pressure values in the pump housing measured at the first measurement time and at the second measurement time is within an allowable range of pressure change, and wherein the first measurement time is determined by adding correction time relating to an operating delay of pumping to a time point when the pressure in the pump housing is detected to be decreased to the reference pressure.

4. A method for evaluating vacuum retention of a cryopump comprising a cryopanel that cools and thus condenses or adsorbs gas, and a pump housing that contains the cryopanel comprising:

instructing to stop pumping when detecting that a pressure in the pump housing decreases to a reference pressure;

determining first measurement time and second measurement time that is later than the first measurement time; and determining whether a difference between pressure values in the pump housing measured at the first measurement time and at the second measurement time is within an allowable range of pressure change, wherein the first measurement time is determined by adding correction time relating to an operating delay of pumping to a time point when the pressure in the pump housing is detected to be decreased to the reference pressure.

5. The method for evaluating vacuum retention of a cryopump according to claim 4, wherein the determining includes:

comparing measurement pressure values in the pump housing acquired a plurality of times after instructing to stop pumping; and determining the first measurement time as a time point when a minimum pressure value among the measurement pressure values is measured.

* * * * *